US009852675B2

(12) United States Patent
Fujii

(10) Patent No.: US 9,852,675 B2
(45) Date of Patent: Dec. 26, 2017

(54) DATA COMPENSATOR TO MITIGATE LUMINANCE DISTORTION OF DISPLAY DEVICE

(71) Applicant: SAMSUNG DISPLAY CO., LTD., Yongin, Gyeonggi-Do (KR)

(72) Inventor: Mitsuru Fujii, Asan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 161 days.

(21) Appl. No.: 14/793,847

(22) Filed: Jul. 8, 2015

(65) Prior Publication Data

US 2016/0217722 A1 Jul. 28, 2016

(30) Foreign Application Priority Data

Jan. 27, 2015 (KR) ..... 10-2015-0012629

(51) Int. Cl.
*G09G 3/20* (2006.01)
*G09G 3/3258* (2016.01)

(52) U.S. Cl.
CPC ..... *G09G 3/2003* (2013.01); *G09G 3/3258* (2013.01); *G09G 2320/0223* (2013.01); *G09G 2320/0233* (2013.01); *G09G 2320/0285* (2013.01)

(58) Field of Classification Search
CPC ..... G09G 3/2003; G09G 3/3258; G09G 2320/0223; G09G 2320/0233; G09G 2320/0285
See application file for complete search history.

(56) References Cited

U.S. PATENT DOCUMENTS

2010/0020065 A1 1/2010 Takasugi
2013/0009939 A1 1/2013 Ebisuno et al.
2013/0147693 A1* 6/2013 Bae ..... G09G 3/3208 345/82
2014/0118409 A1* 5/2014 Jun ..... G09G 5/02 345/690
2014/0285533 A1 9/2014 Chun et al.
2014/0375700 A1 12/2014 Takahama et al.
2016/0035289 A1* 2/2016 Inada ..... G09G 3/3406 345/690

FOREIGN PATENT DOCUMENTS

JP 2004-109191 A 4/2004
KR 10-2009-0116874 A 11/2009
KR 10-2010-0068075 A 6/2010
KR 10-2011-0123952 A 11/2011
KR 10-2012-0111675 A 10/2012
KR 10-2016-0047618 A 5/2016

OTHER PUBLICATIONS

European Search Report dated Apr. 8, 2016 in Corresponding European Patent Application No. 15187565.5.

* cited by examiner

*Primary Examiner* — Larry Sternbane
(74) *Attorney, Agent, or Firm* — Lee & Morse, P.C.

(57) ABSTRACT

A data compensator includes a reference voltage drop generator, a voltage drop measurer, a compensation data generator, and an output block. The reference voltage drop generator generates reference voltage drops for color image data. The voltage drop measurer calculates pixel voltage drops based on color image data. The compensation data generator generates different color compensation data to compensate luminance and color coordinate distortion.

20 Claims, 17 Drawing Sheets

| RGB GRAY SCALE | RVD(mV) |
|---|---|
| 0 | 0 |
| ⋮ | ⋮ |
| 108 | 15 |
| ⋮ | ⋮ |
| 148 | 30 |
| ⋮ | ⋮ |
| 231 | 80 |
| ⋮ | ⋮ |
| 255 | 100 |

FIG. 8

300-1

| Yn | x=1 | x=2 | x=3 | x=4 | x=5 | x=6 | x=7 | x=8 | x=9 |
|---|---|---|---|---|---|---|---|---|---|
| 1 | 0.103 | 0.109 | 0.113 | 0.116 | 0.119 | 0.116 | 0.113 | 0.109 | 0.103 |
| 2 | 0.102 | 0.108 | 0.114 | 0.116 | 0.119 | 0.116 | 0.114 | 0.108 | 0.102 |
| 3 | 0.100 | 0.107 | 0.114 | 0.119 | 0.121 | 0.119 | 0.114 | 0.107 | 0.100 |
| 4 | 0.094 | 0.105 | 0.115 | 0.123 | 0.126 | 0.123 | 0.115 | 0.105 | 0.094 |
| 5 | 0.089 | 0.101 | 0.115 | 0.128 | 0.133 | 0.128 | 0.115 | 0.101 | 0.089 |
| 6 | 0.080 | 0.095 | 0.114 | 0.136 | 0.147 | 0.136 | 0.114 | 0.095 | 0.080 |
| 7 | 0.070 | 0.085 | 0.110 | 0.147 | 0.177 | 0.147 | 0.110 | 0.085 | 0.070 |
| 8 | 0.056 | 0.070 | 0.093 | 0.140 | 0.280 | 0.140 | 0.093 | 0.070 | 0.056 |
| 9 | 0.070 | 0.085 | 0.110 | 0.147 | 0.177 | 0.147 | 0.110 | 0.085 | 0.070 |

y=1 y=2 y=3 y=4 y=5 y=6 y=7 y=8 y=9

X

Y $S_{5,8}(x,7)$ $S_{5,8}(8,7)$

CSB(m=5, n=8)

DATA COMPENSATOR TO MITIGATE LUMINANCE DISTORTION OF DISPLAY DEVICE

CROSS-REFERENCE TO RELATED APPLICATION

Korean Patent Applications No. 10-2015-0012629, filed on Jan. 27, 2015, and entitled, "Data Compensator and Display Device Including the Same," is incorporated by reference herein in its entirety.

BACKGROUND

1. Field

One or more embodiments described herein relate a data compensator and a display device including a data compensator.

2. Description of the Related Art

An organic light emitting display device generates images using organic light emitting diodes. Each diode emits light based on a recombination of electrons and holes in an active layer. The emitted light has a grayscale value based on current from a driving transistor. The current is supplied in an amount that corresponds to image data.

In operation, a voltage drop (IR-drop) may occur across wires that supply power voltages and data signals to the pixels. The voltage drop may adversely affect image quality. For example, the voltage drop may cause a power voltage to be supplied to the pixels which is lower than an applied power voltage. The lower voltage affects the amount of current flowing through the driving TFTs of the pixels, thereby degrading long range uniformity (LRU) of the display device.

SUMMARY

In accordance with one or more embodiments, a data compensator includes a reference voltage drop generator to generate R, G, and B reference voltage drops corresponding to R, G, and B data of a first pixel among the plurality of pixels in a display panel; a voltage drop measurer to calculate pixel voltage drops of the pixels based on R, G, and B data of the pixels, which are sequentially input as the R, G, and B data of the first pixel, the voltage drop measurer to output a first pixel voltage drop of the first pixel; a compensation data generator to generate R, G, and B compensation data compensating a luminance distortion of the first pixel and a color coordinate distortion of the first pixel based on a difference between the first pixel voltage drop and the R, G, and B reference voltage drops, the luminance distortion and the color coordinate distortion corresponding to the first pixel voltage drop; and an output block to generate compensated R, G, and B data by adding the R, G, and B data of the first pixel and the R, G, and B compensation data, respectively.

The reference voltage drop generator may generate the R, G, and B reference voltage drops corresponding to the R, G, and B data of the first pixel based on a pre-defined relationship between gray level and reference voltage drop.

The reference voltage drop generator may store a formula representing the pre-defined relationship, the reference voltage drop generator may generate the R, G, and B reference voltage drops by assigning gray levels of the R, G, and B data of the first pixel as the gray level of the pre-defined relationship.

The reference voltage drop generator may store a look-up table representing the pre-defined relationship, the reference voltage drop generator may generate the R, G, and B reference voltage drops corresponding to gray levels of the R, G, and B data of the first pixel based on the look-up table.

The compensation data generator may generate the R, G, and B compensation data, and each of the R, G, and B compensation data may be in proportion to a difference between the first pixel voltage drop and the R, G, and B reference voltage drops.

The compensation data generator may generate the R, G, and B compensation data having positive values when the first pixel voltage drop is larger than each of the R, G, and B reference voltage drops.

The compensation data generator may generate the R, G, and B compensation data having a value of 0 when the first pixel voltage drop is substantially equal to each of the R, G, and B reference voltage drops. The compensation data generator may generate the R, G, and B compensation data having negative values when the first pixel voltage drop is less than each of the R, G, and B reference voltage drops. The voltage drop measurer may calculate the first pixel voltage drop two-dimensionally.

The pixels may be divided into first through (N)-th blocks, and the voltage drop measurer may include a block voltage drop measurer to calculate a block voltage drop corresponding to a measuring block based on the R, G, and B data of the pixels; a block voltage drop storage to store the block voltage drop; and a pixel voltage drop calculator to generate the first pixel voltage drop by interpolating a plurality of block voltage drops stored in the block voltage drop storage.

The block voltage drop measurer may include a coefficient table to output an X-axis voltage drop distribution coefficient and a Y-axis voltage drop distribution coefficient which correspond to a current sink block coordinate and a measuring block coordinate, the current sink block coordinate to point to a current sink block and the measuring block coordinate to point to the measuring block; a block current calculator to output a current of the current sink block based on the R, G, and B data of the pixels and the current sink block coordinate; a coordinate generator to generate the measuring block coordinate and to generate the current sink block coordinate moving through all coordinates of the first through (N)-th blocks; and a block voltage drop calculator to calculate a block voltage drop of the measuring block, which is generated by the currents of the first through (N)-th blocks, based on the X-axis voltage drop distribution coefficient, the Y-axis voltage drop distribution coefficient, and the current of the current sink block, the block voltage drop calculator to output the block voltage drop of the measuring block as the block voltage drop.

The block current calculator may include a current converter to convert the R, G, and B data of the pixels to a plurality of pixel currents; a block current adder to store a sum of pixels currents corresponding to pixels included in (K)-th block among the first through (N)-th blocks as current of the (K)-th block (K is a natural number less than or equal to N); and a multiplexer to output current of a block corresponding to the current sink block coordinate among the currents of the first through (N)-th block as current of the current sink block.

A first X-axis voltage drop distribution coefficient may be equal to a second X-axis voltage drop distribution coefficient when a first vector and a second vector are symmetric with respect to an X-axis, the first X-axis voltage drop distribution coefficient may correspond to a first current sink block coordinate and a first measuring block coordinate, the second X-axis voltage drop distribution coefficient may correspond to a second current sink block coordinate and a second measuring block coordinate, the first vector may be from the first current sink block coordinate to the first measuring block coordinate, and the second vector may be from the second current sink block coordinate to the second measuring block coordinate.

The coefficient table may only store the first X-axis voltage drop distribution coefficient among the first and second X-axis voltage drop distribution coefficients, the coefficient table may output the first X-axis voltage drop distribution coefficient in response to the second current sink block coordinate and the second measuring block coordinate.

A first X-axis voltage drop distribution coefficient may be equal to a second X-axis voltage drop distribution coefficient when a first vector and a second vector are symmetric with respect to a Y-axis, the first X-axis voltage drop distribution coefficient may correspond to a first current sink block coordinate and a first measuring block coordinate, the second X-axis voltage drop distribution coefficient may correspond to a second current sink block coordinate and a second measuring block coordinate, the first vector may be from the first current sink block coordinate to the first measuring block coordinate, and the second vector may be from the second current sink block coordinate to the second measuring block coordinate.

The coefficient table may only store the first X-axis voltage drop distribution coefficient among the first and second X-axis voltage drop distribution coefficients, the coefficient table may output the first X-axis voltage drop distribution coefficient in response to the second current sink block coordinate and the second measuring block coordinate.

In accordance with one or more other embodiments, a display device includes a display panel including a plurality of pixels; a data compensator to generate compensated R, G, and B data based on R, G, and B data of a first pixel among the pixels; a timing controller to generate a data driver control signal and a scan driver control signal based on the compensated R, G, and B data; a data driver to generate a plurality of data signals based on the data driver control signal, the data driver to provide the data signals to the pixels through a plurality of data signal lines; and a scan driver to generate a plurality of scan signals based on the scan driver control signal, the scan driver to provide the scan signals to the pixels through a plurality of scan signal lines.

The data compensator may include a reference voltage drop generator to generate R, G, and B reference voltage drops corresponding to R, G, and B data of the first pixel; a voltage drop measurer to calculate pixel voltage drops of the pixels based on R, G, and B data of the pixels, which are sequentially input as R, G, and B data of the first pixel, the voltage drop measurer to output a first pixel voltage drop of the first pixel; a compensation data generator to generate R, G, and B compensation data to compensate a distortion of the first pixel based on the first pixel voltage drop and the R, G, and B reference voltage drops, the distortion generated by the first pixel voltage drop; and an output block to generate the compensated R, G, and B data by adding the R, G, and B data of the first pixel and the R, G, and B compensation data, respectively.

The compensation data generator may generate the R, G, and B compensation data to reduce a luminance distortion of the first pixel and a color coordinate distortion of the first pixel simultaneously based on difference between the first pixel voltage drop and the R, G, and B reference voltage drops when the display device operates in a first mode to reduce the luminance distortion and the color coordinate distortion, the compensation data generator may generate the R, G, and B compensation data to reduce the luminance distortion based on the first pixel voltage drop when the display device operates in a second mode to reduce power consumption.

In accordance with one or more other embodiments, a non-transitory computer-readable medium stores code for controlling operation of a display device, the code comprising: first code to generate R, G, and B reference voltage drops corresponding to R, G, and B data of a first pixel among a plurality of pixels; second code to calculate pixel voltage drops of the pixels based on R, G, and B data of the pixels, which are sequentially input as the R, G, and B data of the first pixel, and to output a first pixel voltage drop of the first pixel; third code to generate R, G, and B compensation data to compensate a luminance distortion of the first pixel and a color coordinate distortion of the first pixel based on a difference between the first pixel voltage drop and the R, G, and B reference voltage drops, the luminance distortion and the color coordinate distortion corresponding to the first pixel voltage drop; and fourth code to generate compensated R, G, and B data by adding the R, G, and B data of the first pixel and the R, G, and B compensation data, respectively. The first code may generate the R, G, and B reference voltage drops corresponding to the R, G, and B data of the first pixel based on a pre-defined relationship between gray level and reference voltage drop.

BRIEF DESCRIPTION OF THE DRAWINGS

Features will become apparent to those of skill in the art by describing in detail exemplary embodiments with reference to the attached drawings in which:

FIG. 8 illustrates an example of an X-axis voltage drop distribution coefficient and a Y-axis voltage drop distribution coefficient of the voltage drop measurer;

DETAILED DESCRIPTION

Figure 1:
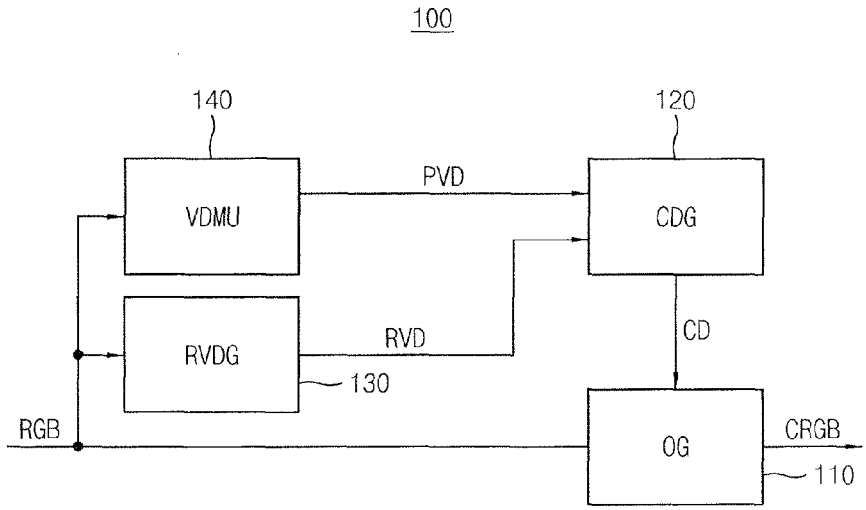
FIG. 1 illustrates an embodiment of data compensator.

Example embodiments are described hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

FIG. 1 illustrates an embodiment of a data compensator 100 which includes a reference voltage generator RVDG 130, a voltage drop measurer VDMU 140, a compensation data generator CDG 120, and an output block OG 110.

The reference voltage drop generator 130 generates R, G, and B reference voltage drops RVD corresponding to R, G, and B data RGB of a first pixel among a plurality of pixels in a display panel. The voltage drop measurer 140 calculates pixel voltage drops of the pixels based on R, G, and B data of the pixels, which are sequentially input as the R, G, and B data RGB of the first pixel.

The voltage drop measurer 140 outputs a first pixel voltage drop PVD of the first pixel. The compensation data generator 120 generates R, G, and B compensation data CD compensating a luminance distortion of the first pixel and a color coordinate distortion of the first pixel based on difference between the first pixel voltage drop PVD and the R, G, and B reference voltage drops RVD. The luminance distortion and the color coordinate distortion are generated by the first pixel voltage drop PVD. The output block 110 generates compensated R, G, and B data CRGB by adding the R, G, and B data RGB of the first pixel and the R, G, and B compensation data CD, respectively.

The reference voltage drop generator 130 may generate the R, G, and B reference voltage drops RVD corresponding to the R, G, and B data RGB of the first pixel based on a pre-defined relationship between gray level and reference voltage drop. An embodiment of the reference voltage drop generator 130 is described with reference to FIGS. 2 and 3.

The voltage drop measurer 140 may calculate the first pixel voltage drop PVD two-dimensionally. An embodiment of the voltage drop measurer 140 is described with reference to FIG. 7.

The compensation data generator 120 generates the R, G, and B compensation data CD, each of which is in proportion to difference between the first pixel voltage drop PVD and the R, G, and B reference voltage drops RVD. An embodiment describing the operation of the compensation data generator 120 is described with reference to FIGS. 4 and 5.

Figure 2:
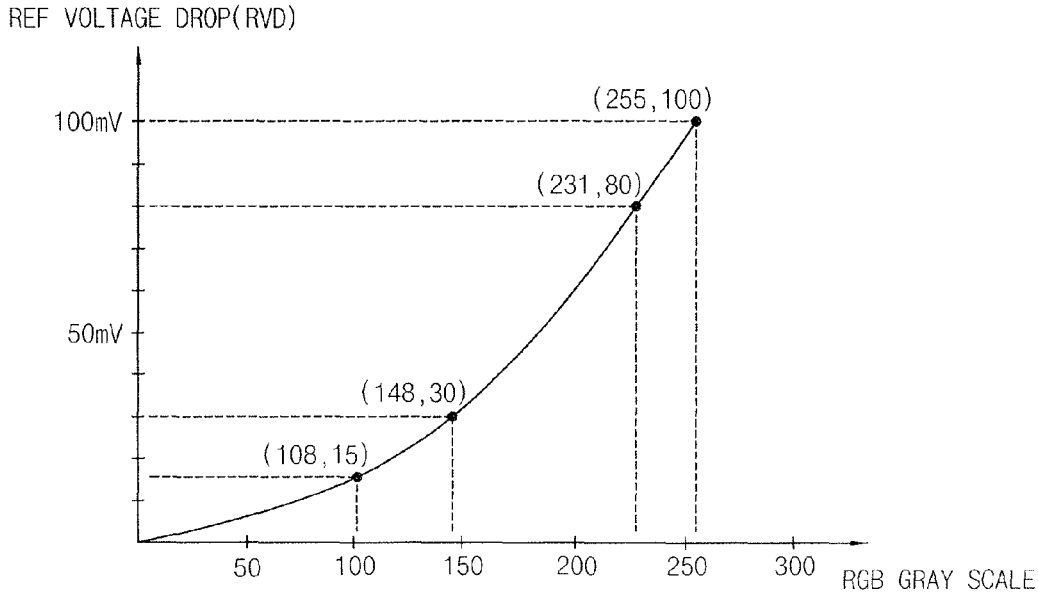
FIG. 2 illustrates an example of a relationship between gray level and reference voltage drop.

FIG. 2 is a graph illustrating an example of a relationship between gray level and reference voltage drop. Information indicative of this relationship may be stored in the reference voltage drop generator in the data compensator of FIG. 1.

Referring to FIG. 2, the reference voltage drop generator 130 may store a formula representing the pre-defined relationship between gray level RGB GRAY SCALE and reference voltage drop RVD. FIG. 2 shows an example of the pre-defined relationship. According to this example, when gray level of R data among the R, G, and B data RGB of the first pixel is 108, the reference voltage drop generator 130 generates 15 mV corresponding to 108 as the R reference voltage drop. When gray level of G data among the R, G, and B data RGB of the first pixel is 108, the reference voltage drop generator 130 generates 15 mV corresponding to 108 as the G reference voltage drop. When gray level of B data among the R, G, and B data RGB of the first pixel is 108, the reference voltage drop generator 130 generates 15 mV corresponding to 108 as the B reference voltage drop.

Figures 3, 4:
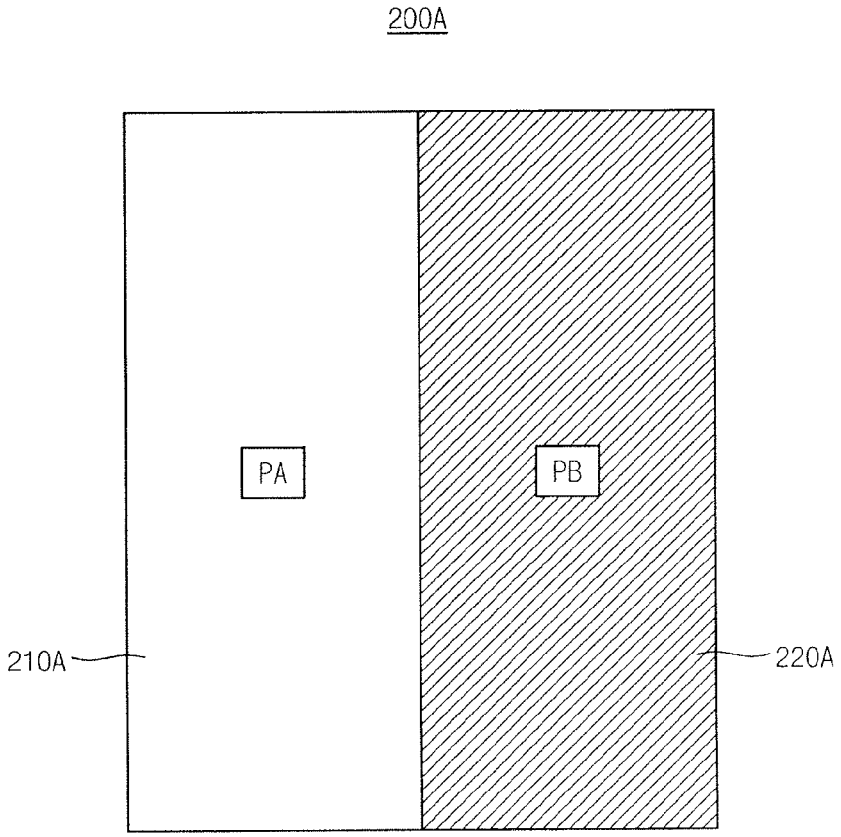
FIG. 3 illustrates an example of a look-up table indicating a relationship between gray level and reference voltage drop.
FIGS. 4 and 5 illustrate examples of operations performed by the compensation data generator.

FIG. 3 illustrates an example of a look-up table indicating a relationship between gray level and reference voltage drop. The look-up table may be stored in the reference voltage drop generator in the data compensator of FIG. 1.

Referring to FIG. 3, the reference voltage drop generator 130 stores a look-up table representing the pre-defined relationship between gray level RGB GRAY SCALE and reference voltage drop RVD. FIG. 3 shows an example of the look-up table. The reference voltage drop generator 130 generates the R, G, and B reference voltage drops RVD corresponding to gray levels RGB GRAY SCALE of the R, G, and B data RGB of the first pixel based on the look-up table, respectively. The look-up table of FIG. 3 may be understood based on the graph of FIG. 2.

Figure 5:
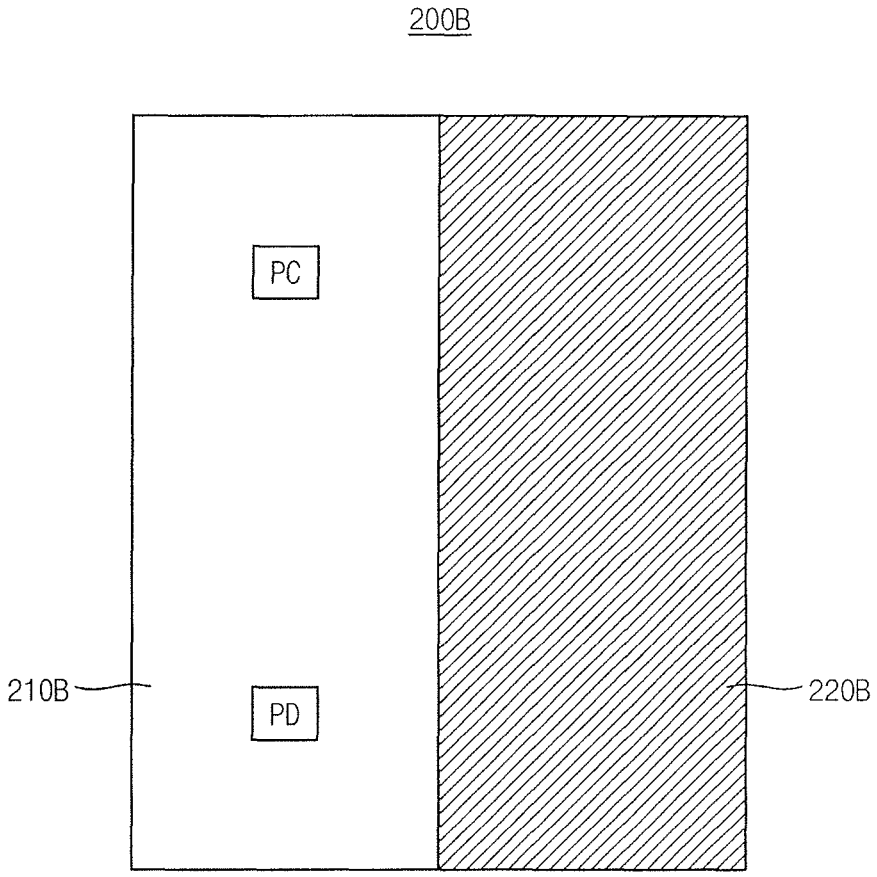

FIGS. 4 and 5 illustrate examples of the operation of the compensation data generator 120 in the data compensator of FIG. 1. The compensation data generator 120 generates the R, G, and B compensation data CD having positive values when the first pixel voltage drop PVD is larger than each of the R, G, and B reference voltage drops RVD. The compensation data generator 120 generates the R, G, and B compensation data CD having 0 when the first pixel voltage drop PVD is the same as each of the R, G, and B reference voltage drops RVD. The compensation data generator 120 generates the R, G, and B compensation data CD having negative values when the first pixel voltage drop PVD is less than each of the R, G, and B reference voltage drops RVD.

Referring to FIG. 4, the display panel 200A may be divided into a first area 210A displayed with relatively high luminance and a second area 220A displayed with relatively low luminance. The first pixel PA is in the first area 210A and the second pixel PB is in the second area 220A. The R data of the first pixel PA has a value of 231, the G data of the first pixel PA has a value of 148, and the B data of the first pixel PA has a value of 108. The R, G, and B data of the second pixel PB is the same as the R, G, and B data of the first pixel PA. In FIG. 4, a case is illustrated where the voltage drop measurer 140 measures the first pixel voltage drop of the first pixel PA as 80 mV and measures the second pixel voltage drop of the second pixel PB as 30 mV.

The reference voltage drop generator 130 may output the first R reference voltage drop (80 mV) corresponding to the R data (231) of the first pixel PA, may output the first G reference voltage drop (30 mV) corresponding to the G data (148) of the first pixel PA, and may output the first B reference voltage drop (15 mV) corresponding to the B data (108) of the first pixel PA.

Because the first pixel voltage drop (80 mV) of the first pixel PA is the same as the first R reference voltage drop (80 mV), the compensation data generator 120 may generate the first R compensation data having a value of 0. Because the first pixel voltage drop (80 mV) of the first pixel PA is larger than the first G reference voltage drop (30 mV), the compensation data generator 120 may generate the first G compensation data having a value of +11, which is in proportion to difference (50 mV) between the first pixel voltage drop (80 mV) and the first G reference voltage drop (30 mV). Because the first pixel voltage drop (80 mV) of the first pixel PA is larger than the first B reference voltage drop (15 mV), the compensation data generator 120 may generate the first B compensation data having a value of +11, which is in proportion to difference (65 mV) between the first pixel voltage drop (80 mV) and the first B reference voltage drop (15 mV). Thus, the compensation data generator 120 may generate the first R, G, and B compensation data (0, +11, +11) corresponding to the first pixel voltage drop (80 mV) of the first pixel PA.

The output block 110 may generate the first compensated R, G, and B data (231, 159, 119) by adding the R, G, and B data (231, 148, 108) of the first pixel PA and the first R, G, and B compensation data (0, +11, +11), respectively.

The reference voltage drop generator 130 outputs the second R reference voltage drop (80 mV) corresponding to the R data (231) of the second pixel PB, outputs the second G reference voltage drop (30 mV) corresponding to the G data (148) of the second pixel PB, and outputs the second B reference voltage drop (15 mV) corresponding to the B data (108) of the second pixel PB.

Because the second pixel voltage drop (30 mV) of the second pixel PB is less than the second R reference voltage drop (80 mV), the compensation data generator 120 may generate the second R compensation data having a value of −12, which is in proportion to difference (−50 mV) between the second pixel voltage drop (30 mV) and the second R reference voltage drop (80 mV). Because the second pixel voltage drop (30 mV) of the second pixel PB is the same as the second G reference voltage drop (30 mV), the compensation data generator 120 may generate the second G compensation data having a value of 0. Because the second pixel voltage drop (30 mV) of the second pixel PB is larger than the second B reference voltage drop (15 mV), the compensation data generator 120 may generate the second B compensation data having a value of +2, which is in proportion to difference (15 mV) between the second pixel voltage drop (30 mV) and the second B reference voltage drop (15 mV). Thus, the compensation data generator 120 may generate the second R, G, and B compensation data (−12, 0, +2) corresponding to the second pixel voltage drop (30 mV) of the second pixel PB.

The output block 110 may generate the second compensated R, G, and B data (219, 148, 110) by adding the R, G, and B data (231, 148, 108) of the second pixel PB and the second R, G, and B compensation data (−12, 0, +2), respectively.

As described above, data compensator 100 compensates luminance distortion and color coordinate distortion of the first and second pixels PA, PB based on difference between the first and second pixel voltage drops (80 mV, 30 mV) and the first and second R, G, and B reference voltage drops corresponding to the R, G, and B data of the first and second pixels PA, PB.

Referring to FIG. 5, the display panel 200B may be divided into a first area 210B displayed with relatively high luminance and a second area 220B displayed with relatively low luminance. The third pixel PC is in an upper portion of the first area 210B. The fourth pixel PD is in the first area 210B. The R data, G data, and B data of the third pixel PC is 255. The R, G, and B data of the fourth pixel PD is the same as the R, G, and B data of the third pixel PC. In FIG. 5, a case is illustrated where the voltage drop measurer 140 measures the third pixel voltage drop of the third pixel PC as 30 mV and measures the fourth pixel voltage drop of the fourth pixel PD as 90 mV.

The reference voltage drop generator 130 outputs the third R reference voltage drop (100 mV) corresponding to the R data (255) of the third pixel PC, outputs the third G reference voltage drop (100 mV) corresponding to the G data (255) of the third pixel PC, and outputs the third B reference voltage drop (100 mV) corresponding to the B data (255) of the third pixel PC.

Because the third pixel voltage drop (30 mV) of the third pixel PC is less than the third R reference voltage drop (100 mV), the compensation data generator 120 may generate the third R compensation data having a value of −17, which is in proportion to difference (−70 mV) between the third pixel voltage drop (30 mV) and the third R reference voltage drop (100 mV). Because the third pixel voltage drop (30 mV) of the third pixel PC is less than the third G reference voltage drop (100 mV), the compensation data generator 120 may generate the third G compensation data having a value of −17, which is in proportion to difference (−70 mV) between the third pixel voltage drop (30 mV) and the third G reference voltage drop (100 mV). Because the third pixel voltage drop (30 mV) of the third pixel PC is less than the third B reference voltage drop (100 mV), the compensation data generator 120 may generate the third B compensation data having a value of −17, which is in proportion to difference (−70 mV) between the third pixel voltage drop (30 mV) and the third B reference voltage drop (100 mV). Thus, the compensation data generator 120 may generate the third R, G, and B compensation data (−17, −17, −17) corresponding to the third pixel voltage drop (30 mV) of the third pixel PC.

The output block 110 may generate the third compensated R, G, and B data (238, 238, 238) by adding the R, G, and B data (255, 255, 255) of the third pixel PC and the third R, G, and B compensation data (−17, −17, −17), respectively.

The reference voltage drop generator 130 may output the fourth R reference voltage drop (100 mV) corresponding to the R data (255) of the fourth pixel PD, may output the fourth G reference voltage drop (100 mV) corresponding to the G data (255) of the fourth pixel PD, and may output the fourth B reference voltage drop (100 mV) corresponding to the B data (255) of the fourth pixel PD.

Because the fourth pixel voltage drop (90 mV) of the fourth pixel PD is less than the fourth R reference voltage drop (100 mV), the compensation data generator 120 may generate the fourth R compensation data having a value of −3, which is in proportion to difference (−10 mV) between the fourth pixel voltage drop (90 mV) and the fourth R reference voltage drop (100 mV). Because the fourth pixel voltage drop (90 mV) of the fourth pixel PD is less than the fourth G reference voltage drop (100 mV), the compensation data generator 120 may generate the fourth G compensation data having a value of −3, which is in proportion to difference (−10 mV) between the fourth pixel voltage drop (90 mV) and the fourth G reference voltage drop (100 mV). Because the fourth pixel voltage drop (90 mV) of the fourth pixel PD is less than the fourth B reference voltage drop (100 mV), the compensation data generator 120 may generate the fourth B compensation data having a value of −3, which is in proportion to difference (−10 mV) between the fourth pixel voltage drop (90 mV) and the fourth B reference voltage drop (100 mV). Thus, the compensation data generator 120 may generate the fourth R, G. and B compensation data (−3,−3, −3) corresponding to the fourth pixel voltage drop (90 mV) of the fourth pixel PD.

The output block 110 may generate the fourth compensated R, G, and B data (252, 252, 252) by adding the R, G, and B data (255, 255, 255) of the fourth pixel PD and the fourth R, G, and B compensation data (−3, −3, −3), respectively.

Figure 6:
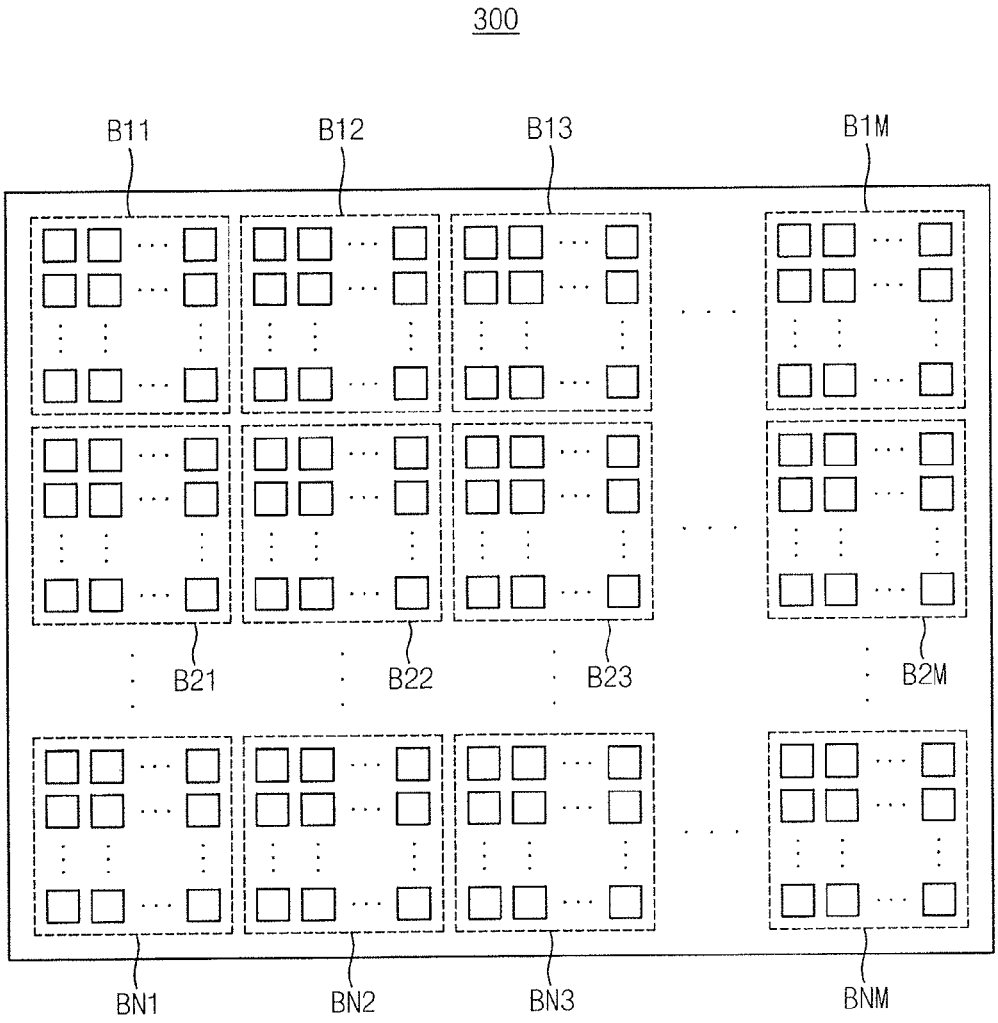
FIG. 6 illustrates an embodiment of a display panel.

FIG. 6 illustrating an embodiment of the display panel having a plurality of blocks, where each block includes a plurality of pixels. Referring to FIG. 6, the display panel 300 includes the first through (N)-th blocks B11, B12, B13 through B1M, B21, B22, B23 through B2M, BN1, BN2, BN3 through BNM. Each of the first through (N)-th blocks B11, B12, B13 through B1M, B21, B22, B23 through B2M, BN1, BN2, BN3 through BNM includes a plurality of pixels.

Figure 7:
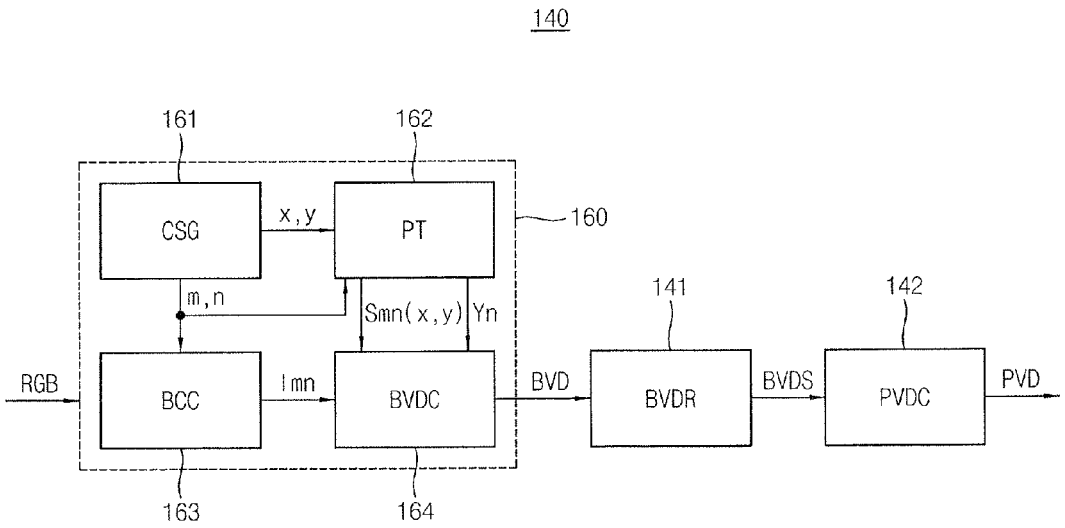
FIG. 7 illustrates an embodiment of a voltage drop measurer.

FIG. 7 illustrates an embodiment of a voltage drop measurer 140, which for example, may be in the data compensator of FIG. 1. Referring to FIG. 7, the voltage drop measurer 140 includes a block voltage drop measurer 160, a block voltage drop storage 141, and a pixel voltage drop calculator 142. The block voltage drop measurer 160 may include a coefficient table PT 162, a block current calculator BCC 163, a coordinate generator CSG 161, and a block voltage drop calculator BVDC 164.

The block voltage drop measurer 160 may calculate a block voltage drop BVD corresponding to a measuring block based on the R, G, and B data of the pixels in the display panel 300 of FIG. 6. The block voltage drop storage BVDR 141 may store the block voltage drop BVD. The pixel voltage drop calculator PVDC 142 may generate the first pixel voltage drop PVD by interpolating a plurality of block voltage drops BVDS stored in the block voltage drop storage 141. An embodiment of the block voltage drop storage 141 is described with the reference to FIG. 17, and an embodiment of the pixel voltage drop calculator 142 is described with the reference to FIG. 18.

The coefficient table 162 outputs an X-axis voltage drop distribution coefficient (Smn(x, y)) and a Y-axis voltage drop distribution coefficient (Yn) which correspond to a current sink block coordinate (m, n) and a measuring block coordinate (x, y). The current sink block coordinate (m, n) may point to a current sink block. The measuring block coordinate (x, y) may point to the measuring block.

The block current calculator 164 may output a current of the current sink block (Imn) based on the R, G, and B data of the pixels and the current sink block coordinate (m, n). The coordinate generator 161 may generate the measuring block coordinate (x, y) and the current sink block coordinate (m, n) moving through all coordinates of the first through (N)-th blocks B11, B12, B13 through B1M, B21, B22, B23 through B2M, BN1, BN2, BN3 through BNM. The block voltage drop calculator 164 may calculate a block voltage drop of the measuring block, which is generated by the currents of the first through (N)-th blocks B11, B12, B13 through B1M, B21, B22, B23 through B2M, BN1, BN2, BN3 through BNM, based on the X-axis voltage drop distribution coefficient (Smn(x, y)), the Y-axis voltage drop distribution coefficient (Yn), and the current of the current sink block (Imn). The block voltage drop calculator 164 may output the block voltage drop of the measuring block as the block voltage drop BVD.

In one example embodiment, the block voltage drop calculator 164 may calculate the block voltage drop BVD corresponding to the measuring block coordinate (x, y) based on Equation 1.

$$BVD(x, y) = Rs \times \sum_{m=1}^{M} \sum_{n=1}^{N} Imn \times Smn(x, y) \times Yn \tag{1}$$

where Rs is a resistance coefficient, x and m are natural numbers less than or equal to M respectively, y and n are natural numbers less than or equal to N respectively. Each block may have, for example, 120*120 pixels. Also, in one example, M may be 9 and N may be 16.

The Y-axis voltage drop distribution coefficient (Yn) is a voltage drop ratio in Y-axis direction when the supply voltage is applied to a point where y=0. The block voltage drop calculator 164 may calculate the Y-axis voltage drop distribution coefficient (Yn) based on Equation 2.

$$Yn = \begin{cases} y & \dots \quad y \leqq n \\ n & \dots \quad y > n \end{cases} \tag{2}$$

The X-axis voltage drop distribution coefficient (Smn(x, y)) is a ratio of the voltage drop of the measuring block to a sum of the voltage drops of row blocks including the measuring block corresponding to the measuring block coordinate (x, y) when a unit current is provided to the current sink block corresponding to the current sink block coordinate (m, n). Therefore, a sum of the X-axis voltage drop distribution coefficients corresponding to row blocks (e.g. B11, B12, B13 through B1M) becomes 1.

FIG. 8 illustrates examples of an X-axis voltage drop distribution coefficient and a Y-axis voltage drop distribution coefficient of the voltage drop measurer of FIG. 7 In FIG. 8, a case is illustrated where the supply voltage is applied to a line described as y=0 and current flows to the current sink block CSB corresponding to the current sink block coordinate (m=5, n=8).

The Y-axis voltage drop distribution coefficient (Yn) increases until the value of 8, which is Y-axis coordinate (n) of the current sink block (CSB), according to y value. The Y-axis voltage drop distribution coefficient (Yn) is fixed to 8, when y>8. The sum of X-axis voltage drop distribution coefficients (S5, 8(x, 7)) corresponding to the seventh row blocks becomes 1. An X-axis voltage drop distribution coefficient (S5, 8(8, 7)) corresponding to a measuring block coordinate (9, 7) is 0.070.

Figure 9:
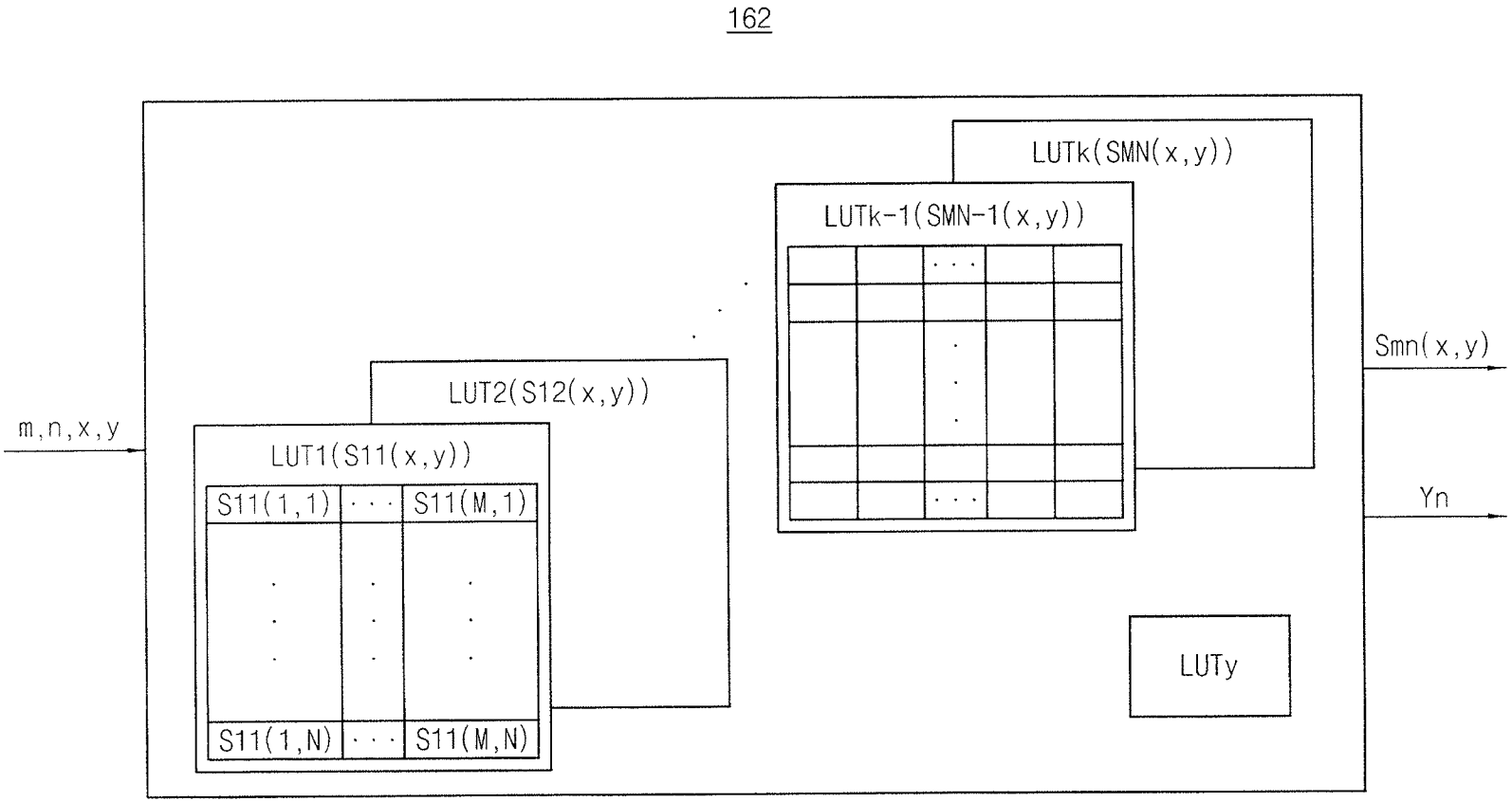
FIG. 9 illustrates an example of a coefficient table for storing the X-axis voltage drop distribution coefficient and Y-axis voltage drop distribution coefficient.

FIG. 9 illustrates an example of a coefficient table which stores the X-axis voltage drop distribution coefficient and Y-axis voltage drop distribution coefficient of FIG. 8 and which may be included in the voltage drop measurer of FIG. 7. Referring to FIG. 9, the coefficient table 162 includes a plurality of look-up tables LUT1 through LUTk, and LUTy corresponding to all current sink block coordinates.

In coefficient table 162, one of the look-up tables LUT1 through LUTk is selected according to the current sink block coordinate (m, n). The coefficient table 162 outputs an X-axis voltage drop distribution coefficient corresponding to the measuring block coordinate (x, y), among the X-axis voltage drop distribution coefficients in the selected look-up table, as the X-axis voltage drop distribution coefficient (Sm,n(x, y)) of the first pixel.

The coefficient table 162 may output a Y-axis voltage drop distribution coefficient corresponding to the measuring block coordinate (x, y) as the Y-axis voltage drop distribution coefficient (Yn) of the first pixel based on the look-up table LUTy implementing Equation 2.

Figure 10:
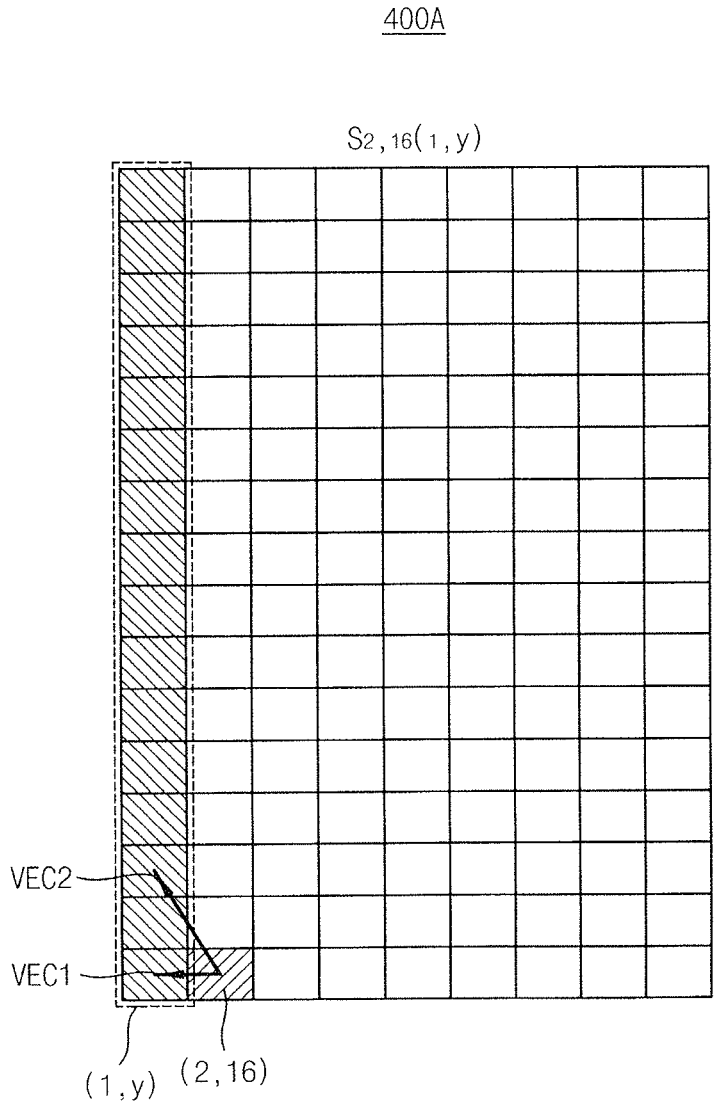
FIGS. 10 through 15 illustrate embodiments of how the coefficient table may reuse X-axis voltage drop distribution coefficients and Y-axis voltage drop distribution coefficients.
Figure 11:
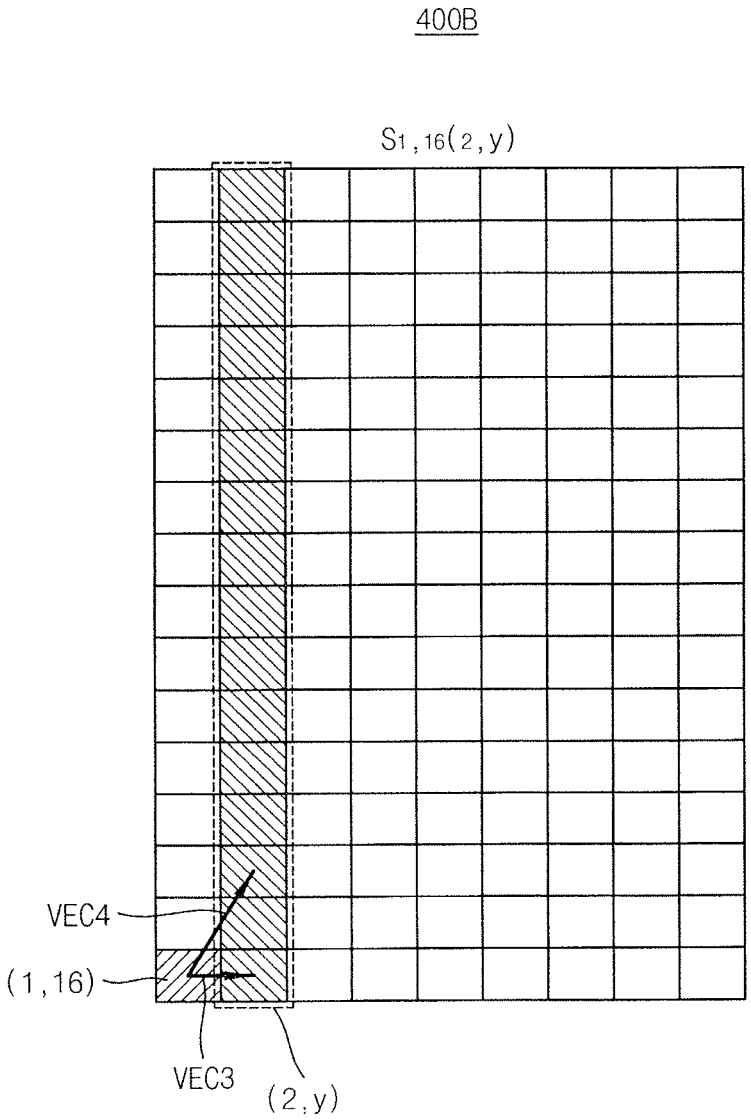

FIGS. 10 to 15 illustrates examples of how the coefficient table of FIG. 9 may reuse X-axis voltage drop distribution coefficients and Y-axis voltage drop distribution coefficients. Referring to FIGS. 10 and 11, because the first vector VEC1 and the third vector VEC3 are symmetric with respect to the X-axis, the first X-axis voltage drop distribution coefficient (S2,16(1, 16)), which corresponds to the first current sink block coordinate (2, 16) and the first measuring block coordinate (1, 16), may be the same as the third X-axis voltage drop distribution coefficient (S1,16(2, 16)), which corresponds to the second current sink block coordinate (1, 16) and the third measuring block coordinate (2, 16). The first vector VEC1 is from the first current sink block coordinate (2, 16) to the first measuring block coordinate (1, 16) in FIG. 10. The third vector VEC3 is from the second current sink block coordinate (1, 16) to the third measuring block coordinate (2, 16) in FIG. 11.

The coefficient table 162 may only store the first X-axis voltage drop distribution coefficient (S2, 16(1, 16)) among the first and third X-axis voltage drop distribution coefficients (S2, 16(1, 16), S1, 16(2, 16)). The coefficient table 162 outputs the first X-axis voltage drop distribution coefficient (S2, 16(1, 16)) based on the second current sink block coordinate (1, 16) and the third measuring block coordinate (2, 16).

Referring to FIGS. 10 and 11, because the second vector VEC2 and the fourth vector VEC4 are symmetric with respect to X-axis, the second X-axis voltage drop distribution coefficient (S2,16(1, 14), which corresponds to the first current sink block coordinate (2, 16) and the second measuring block coordinate (1, 14), may be the same as the fourth X-axis voltage drop distribution coefficient (S1,16(2, 14)), which corresponds to the second current sink block coordinate (1, 16) and the fourth measuring block coordinate (2, 14). The second vector VEC2 is from the first current sink block coordinate (2, 16) to the second measuring block coordinate (1, 14) in FIG. 10. The fourth vector VEC4, which is from the second current sink block coordinate (1, 16) to the fourth measuring block coordinate (2, 14) in FIG. 11.

The coefficient table 162 may only store the second X-axis voltage drop distribution coefficient (S2, 16(1, 14)) among the second and fourth X-axis voltage drop distribution coefficients (S2, 16(1, 14), S1, 16(2, 14)). The coefficient table 162 outputs the second X-axis voltage drop distribution coefficient (S2, 16(1, 14)) based on the second current sink block coordinate (1, 16) and the fourth measuring block coordinate (2, 14). The remaining portions of FIGS. 10 and 11 may be understood based on the foregoing description.

Figure 12:
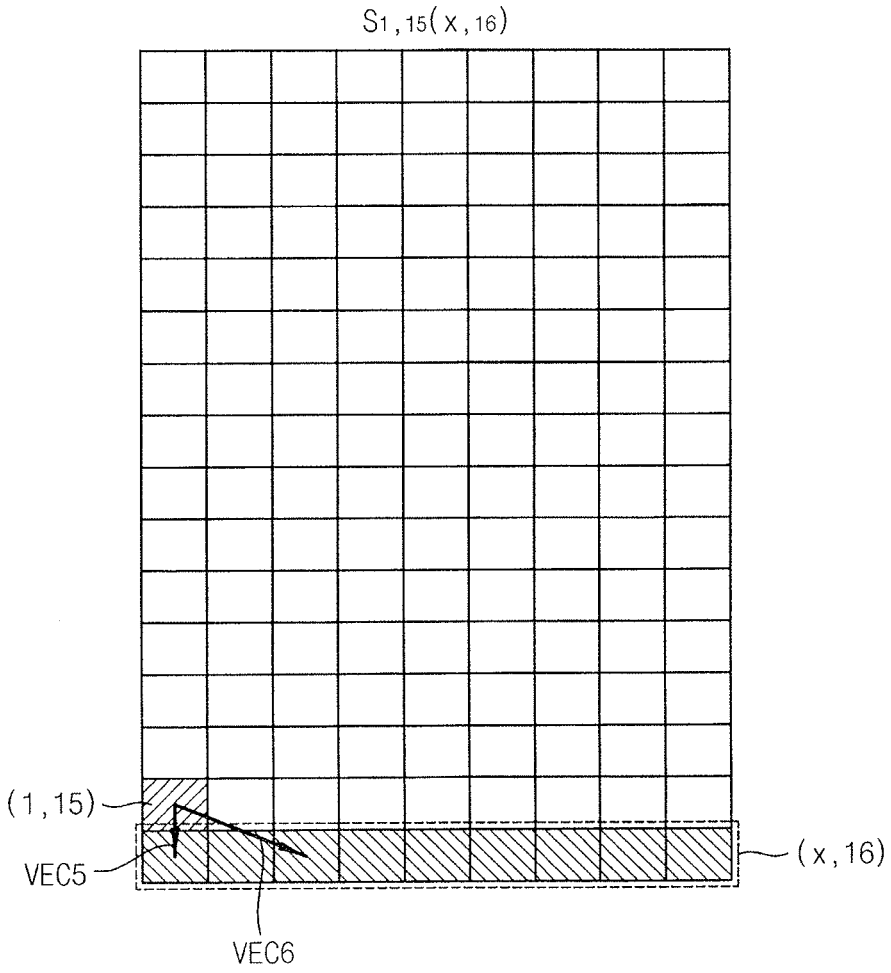
Figure 13:
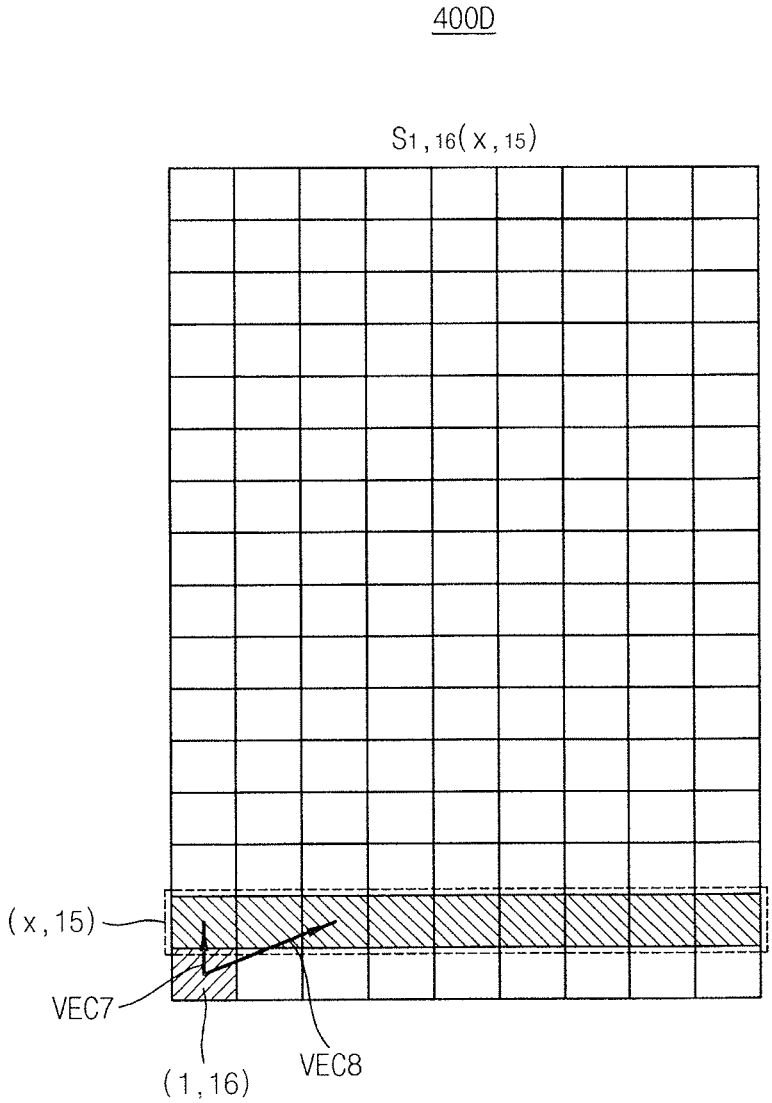
Figure 14:
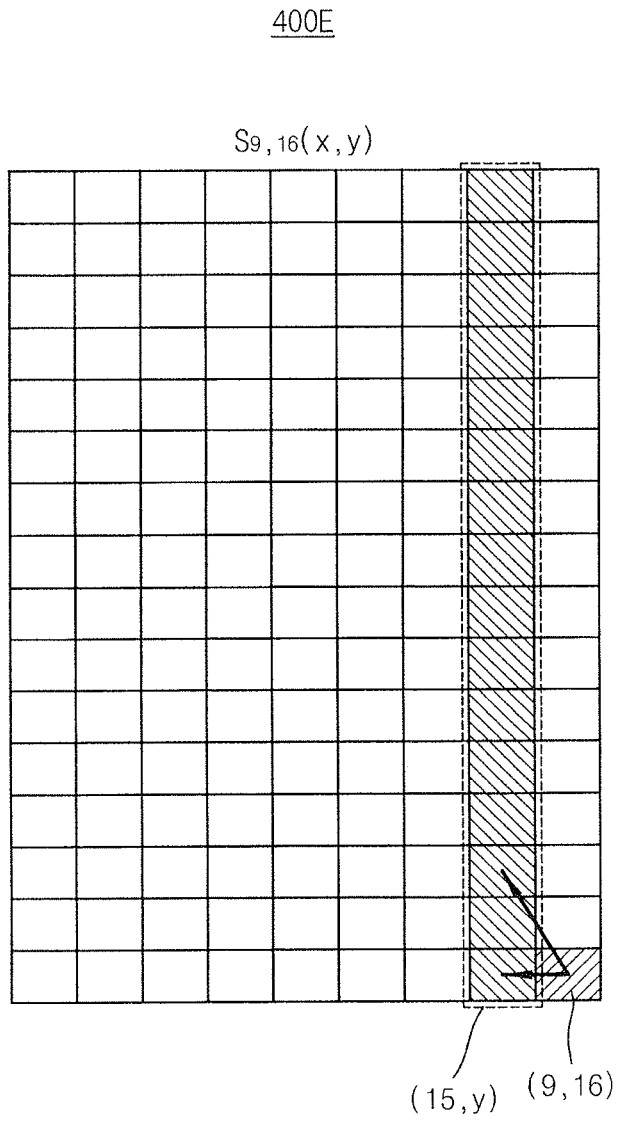
Figure 15:
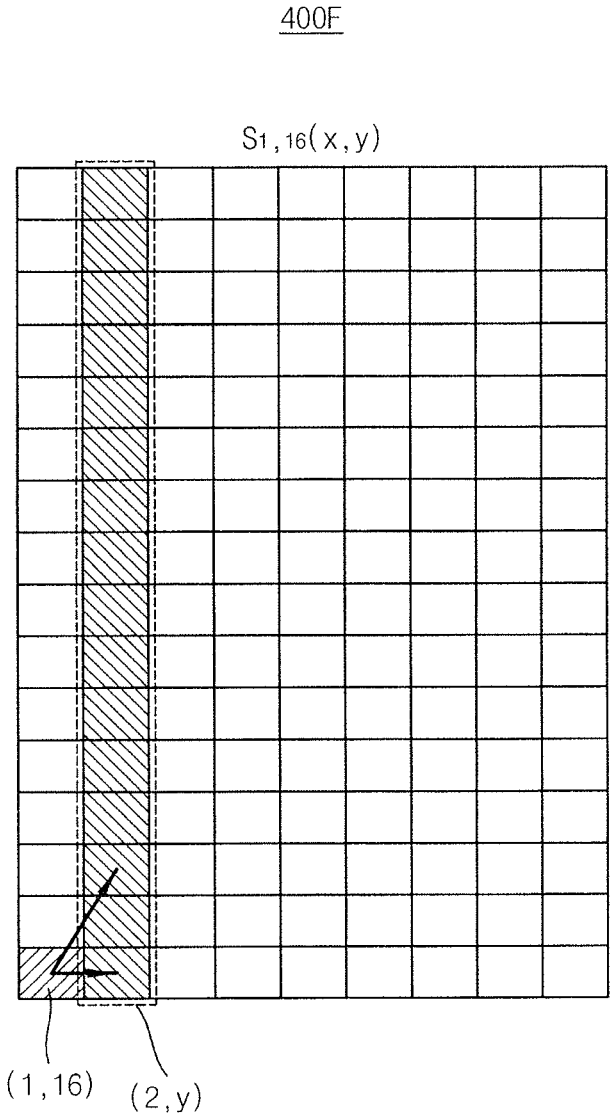

Referring to FIGS. 12 and 13, because the fifth vector VEC5 and the seventh vector VEC7 are symmetric with respect to Y-axis, the fifth X-axis voltage drop distribution coefficient (S1,15(1, 16)), which corresponds to the third current sink block coordinate (1, 15) and the fifth measuring block coordinate (1, 16), may be the same as the seventh X-axis voltage drop distribution coefficient (S1,16(1, 15)), which corresponds to the fourth current sink block coordinate (1, 16) and the seventh measuring block coordinate (1, 15). The fifth vector VEC5 is from the third current sink block coordinate (1, 15) to the fifth measuring block coordinate (1, 16) in FIG. 12. The seventh vector VEC7 is from the fourth current sink block coordinate (1, 16) to the seventh measuring block coordinate (1, 15) in FIG. 13.

The coefficient table 162 may only store the fifth X-axis voltage drop distribution coefficient (S1, 15(1, 16)) among the fifth and seventh X-axis voltage drop distribution coefficients (S1, 15(1, 16), S1, 16(1, 15)). The coefficient table 162 outputs the fifth X-axis voltage drop distribution coefficient (S1, 15(1, 16)) based on the fourth current sink block coordinate (1, 16) and the seventh measuring block coordinate (1, 15).

Referring to FIGS. 12 and 13, because the sixth vector VEC6 and the eighth vector VEC8 are symmetric with respect to Y-axis, the sixth X-axis voltage drop distribution coefficient (S1,15(3, 16)), which corresponds to the third current sink block coordinate (1, 15) and the sixth measuring block coordinate (3, 16), may be the same as the eighth X-axis voltage drop distribution coefficient (S1, 16(3, 15)), which corresponds to the fourth current sink block coordinate (1, 16) and the eighth measuring block coordinate (3, 15). The sixth vector VEC6 is from the third current sink block coordinate (1, 15) to the sixth measuring block coordinate (3, 16) in FIG. 12. The eighth vector VEC8, which is from the fourth current sink block coordinate (1, 16) to the eighth measuring block coordinate (3, 15) in FIG. 13.

The coefficient table 162 may only store the sixth X-axis voltage drop distribution coefficient (S1, 15(3, 16)) among the sixth and eighth X-axis voltage drop distribution coefficients (S1, 15(3, 16), S1, 16(3, 15)). The coefficient table 162 outputs the sixth X-axis voltage drop distribution coefficient (S1, 15(3, 16)) based on the fourth current sink block coordinate (1, 16) and the eighth measuring block coordinate (3, 15). The remaining of FIGS. 12 and 13 may be understood based on the foregoing description, and FIGS. 14 and 15 may be understood based on the foregoing description relating to FIGS. 10 and 13.

Figure 16:
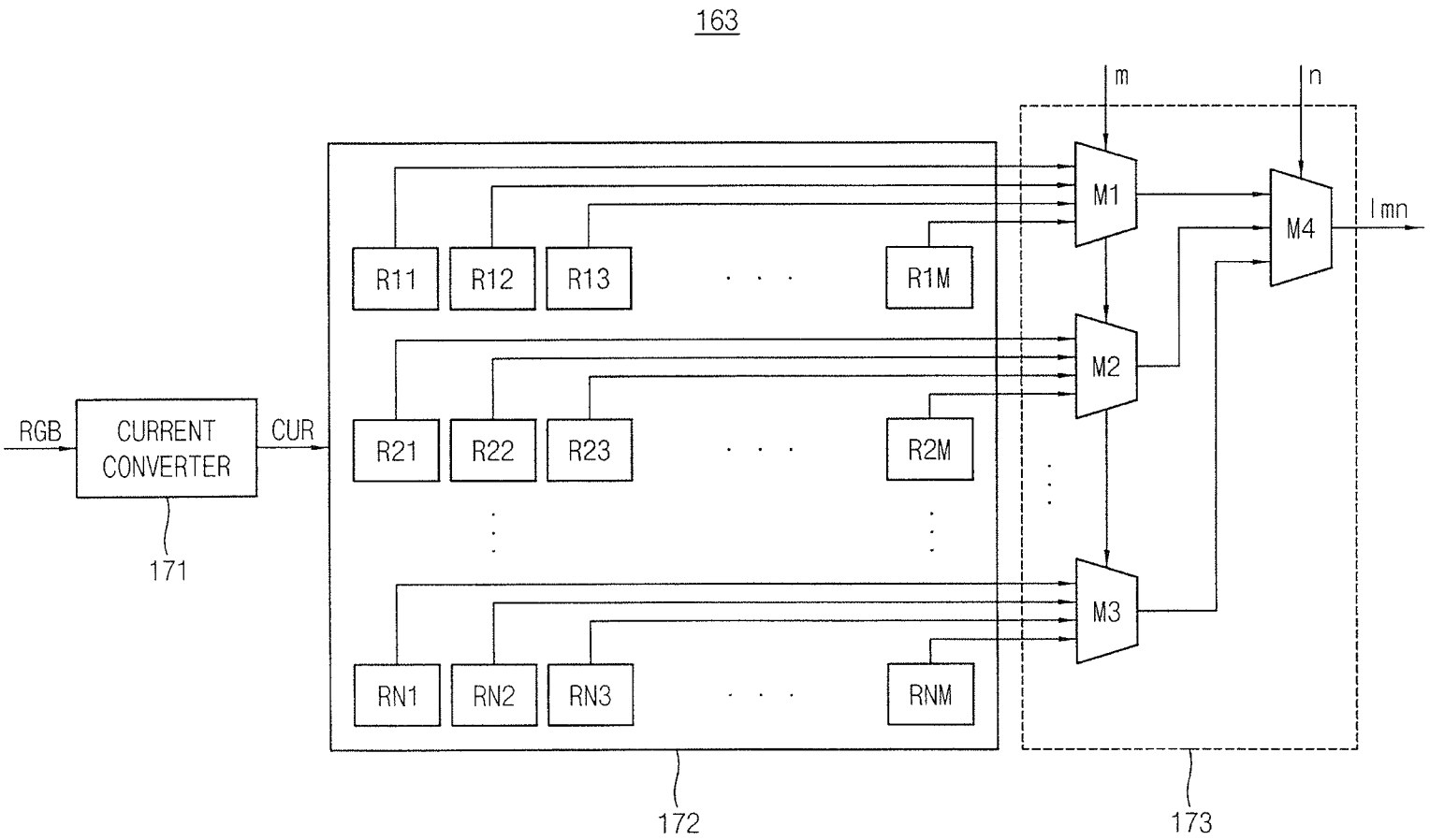
FIG. 16 illustrates an embodiment of a block current calculator.

FIG. 16 illustrates an embodiment of a block current calculator 163 in the voltage drop measurer of FIG. 7. Referring to FIG. 16, the block current calculator 163 includes a current converter 171, a block current adder 172, and a multiplexer 173. The block current adder 172 includes the first through (N)-th block current registers R11, R12, R13 through R1M, R21, R22, R23 through R2M, RN1, RN2, RN3 through RNM corresponding to the first through (N)-th blocks B11, B12, B13 through B1M, B21, B22, B23 through B2M, BN1, BN2, BN3 through BNM in the display panel 300 of FIG. 6.

The current converter 171 converts the R, G, and B data of the pixels, which are sequentially input as the R, G, and B data RGB of the first pixel, to a plurality of pixel currents CUR.

The block current adder 172 stores the sum of pixels currents corresponding to pixels in the first block B11 to the first block current register R11 as current of the first block. The block current adder 172 stores the sum of pixels currents corresponding to pixels included in the second block B12 to the second block current register R12 as current of the second block. The remaining block current registers R13 through R1M, R21, R22, R23 through R2M, RN1, RN2, RN3 through RNM may be understood based on the forgoing description.

The multiplexer 173 outputs current of a block corresponding to the current sink block coordinate (m, n) as current of the current sink block (1 mn).

Figure 17:
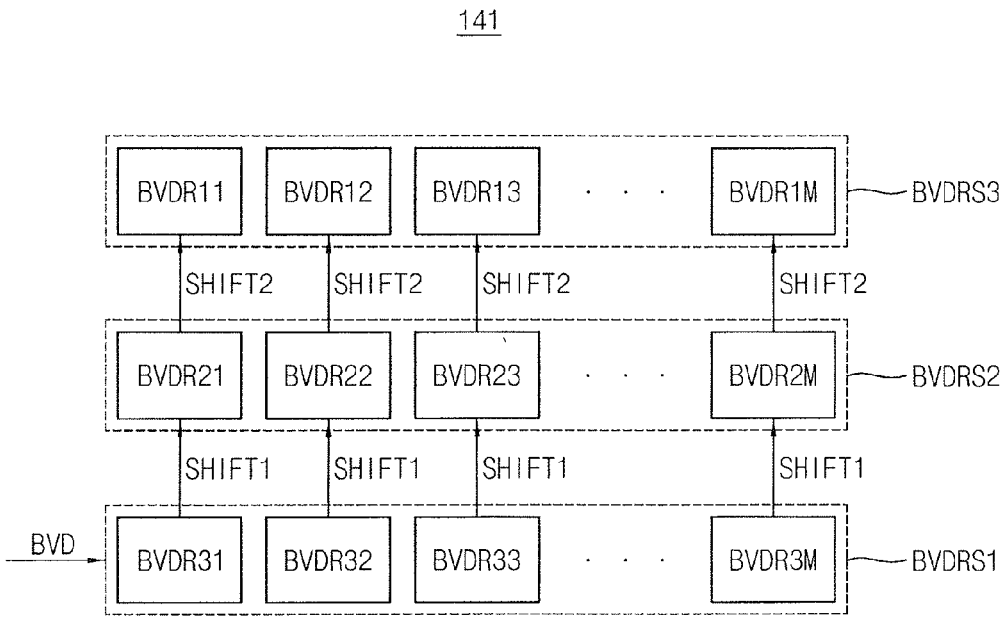
FIG. 17 illustrates an embodiment of a block voltage drop storage.

FIG. 17 illustrates an embodiment of the block voltage drop storage 141 in the voltage drop measurer of FIG. 7. Referring to FIG. 17, the block voltage drop storage 141 includes the first block voltage drop registers RVDRS1, the second block voltage drop registers BVDRS2, and the second block voltage drop registers BVDRS3. The first block voltage drop registers BVDRS1 includes a plurality of block voltage drop registers BVDR11, BVDR12, BVDR13 through BVDR1M. The second block voltage drop registers BVDRS2 includes a plurality of block voltage drop registers BVDR21, BVDR22, BVDR23 through BVDR2M. The third block voltage drop registers BVDRS3 includes a plurality of block voltage drop registers BVDR31, BVDR32, BVDR33 through BVDR3M.

In an example embodiment, when M is 9 and the measuring block coordinate (x, y) moves from (1, 1) to (1, 9) sequentially, the block voltage drop storage 141 stores the block voltage drops BVD of the measuring blocks corresponding to the measuring block coordinates to the (3, 1) block voltage drop register BVDR31 through the (3, M) block voltage drop register BVDR3M sequentially (first storing procedure).

After the first storing procedure, the block voltage drop storage 141 may shift SHIFT1 the stored values of the third block voltage drop registers BVDRS3 to the second block voltage drop registers BVDRS2, and may shift SHIFT2 the stored values of the second block voltage drop registers BVDRS2 to the first block voltage drop registers BVDRS1. Then, the measuring block coordinate (x, y) moves from (2,1) to (2, 9) sequentially, and the block voltage drop storage 141 may store the block voltage drops BVD of the measuring blocks corresponding to the measuring block coordinates to the (3, 1) block voltage drop register BVDR31 through the (3, M) block voltage drop register BVDR3M sequentially (second storing procedure).

After the second storing procedure, the block voltage drop storage 141 may shift SHIFT1 the stored values of the third block voltage drop registers BVDRS3 to the second block voltage drop registers BVDRS2, and may shift SHIFT2 the stored values of the second block voltage drop registers BVDRS2 to the first block voltage drop registers BVDRS1. Then, the measuring block coordinate (x, y) moves from (3,1) to (3, 9) sequentially, and the block voltage drop storage 141 may store the block voltage drops BVD of the measuring blocks corresponding to the measuring block coordinates to the (3, 1) block voltage drop register BVDR31 through the (3, M) block voltage drop register BVDR3M sequentially (third storing procedure).

Figure 18:
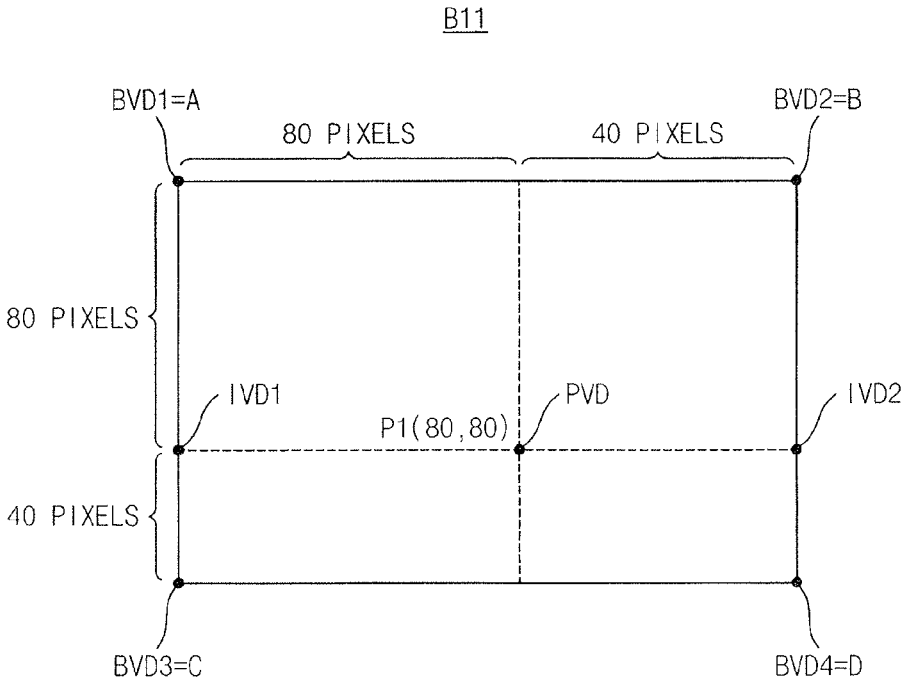
FIG. 18 illustrates an embodiment of a pixel voltage drop calculator.

FIG. 18 illustrates an example of an operation of the pixel voltage drop calculator of FIG. 11. In FIG. 18, a case is illustrated where a block includes 120*120 pixels. The pixel voltage drop calculator 142 calculates the pixel voltage drop PVD of the first pixel P1, which corresponds to a coordinate (80, 80) and is included in the first block B11, after the third storing procedure described the reference to FIG. 17.

After the third storing procedure, a stored value of the (1, 1) block voltage drop register BVDR11 is the first block voltage drop BVD1 of the first block B11, a stored value of the (1, 2) block voltage drop register BVDR12 is the second block voltage drop BVD2 of the second block B12, a stored value of the (2, 1) block voltage drop register BVDR21 is the third block voltage drop BVD3 of the third block B21, and a stored value of the (2, 2) block voltage drop register BVDR22 is the fourth block voltage drop BVD4 of the fourth block BVD4.

When the first block voltage drop BVD1 has a value of A, the second block voltage drop BVD2 has a value of B, the third block voltage drop BVD3 has a value of C, and the fourth block voltage drop BVD4 has a value of D, the pixel voltage drop calculator 142 generates the first interpolated voltage drop IVD1 having a value of (A+2C)/3 by interpolating the first block voltage drop BVD1 and the third block voltage drop BVD3 with a ratio of 80:40. The pixel voltage drop calculator 142 generates the second interpolated voltage drop IVD2 having a value of (B+2D)/3 by interpolating the second block voltage drop BVD2 and the fourth block voltage drop BVD4 with a ratio of 80:40. The pixel voltage drop calculator 142 generates the first pixel voltage drop PVD of the first pixel P1 having a value of (A+2B+2C+4D)/9 by interpolating the first interpolated voltage drop IVD1 and the second interpolated voltage drop IVD2 with a ratio of 80:40.

Figure 19:
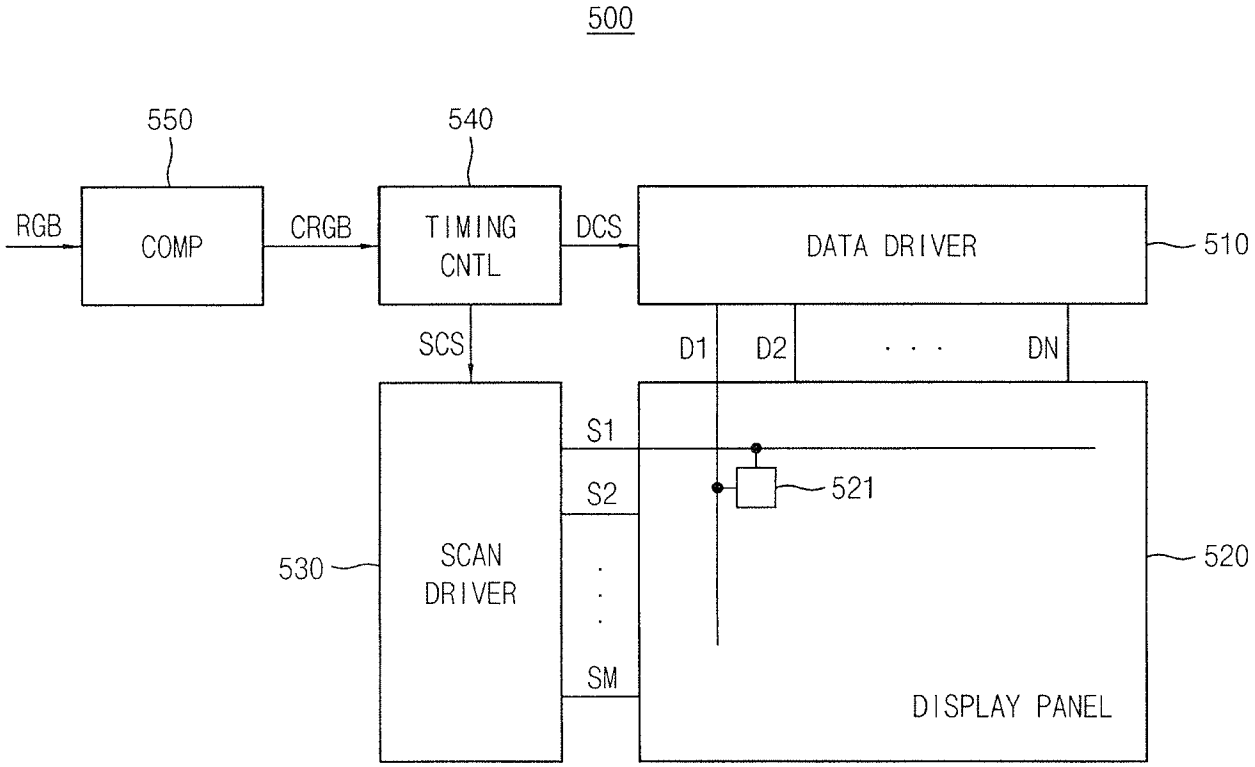
FIG. 19 illustrates an embodiment of a display device.

FIG. 19 illustrates an embodiment of a display device 500 which includes a display panel 520, a data compensator 550, a timing controller 540, a data driver 510, and a scan driver 530. The display panel 520 includes a plurality of pixels 521.

The data compensator 550 generates compensated R, G, and B data CRGB based on R, G, and B data RGB of a first pixel among the pixels 521. The timing controller 540 generates a data driver control signal DCS and a scan driver control signal SCS based on the compensated R, G, and B data CRGB. The data driver 510 generates a plurality of data signals based on the data driver control signal DCS and provides the data signals to the pixels 521 through a plurality of data signal lines D1, D2 through DN. The scan driver 520 generates a plurality of scan signals based on the scan driver control signal SCS, and provides the scan signals to the pixels 521 through a plurality of scan signal lines S1, S2 through SM.

The data compensator 550 includes a reference voltage drop generator, a voltage drop measurer, a compensation data generator, and an output block in accordance with any of the aforementioned embodiments. The reference voltage drop generator generates R, G, and B reference voltage drops corresponding to R, G, and B data RGB of the first pixel. The voltage drop measurer calculates pixel voltage drops of the pixels 521 based on R, G, and B data of the pixels 521, which are sequentially input as R, G, and B data RGB of the first pixel. The voltage drop measurer outputs a first pixel voltage drop of the first pixel. The compensation data generator generates R, G, and B compensation data compensating a distortion of the first pixel based on the first pixel voltage drop and the R, G, and B reference voltage drops. The distortion is generated by the first pixel voltage drop. The output block generates the compensated R, G, and B CRGB data by adding the R, G, and B data of the first pixel and the R, G, and B compensation data, respectively. The data compensator 550 may correspond, for example, to the data compensator 100 of FIG. 1.

When the display device 500 operates in a first mode to minimize the luminance distortion and the color coordinate distortion of the first pixel, the compensation data generator may generate the R, G, and B compensation data reducing or minimizing a luminance distortion and a color coordinate distortion simultaneously based on a difference between the first pixel voltage drop and the R, G, and B reference voltage drops. When the display device 500 operates in a second mode to minimize power consumption, the compensation data generator may generate the R, G, and B compensation data reducing or minimizing the luminance distortion based on the first pixel voltage drop.

Figure 20:
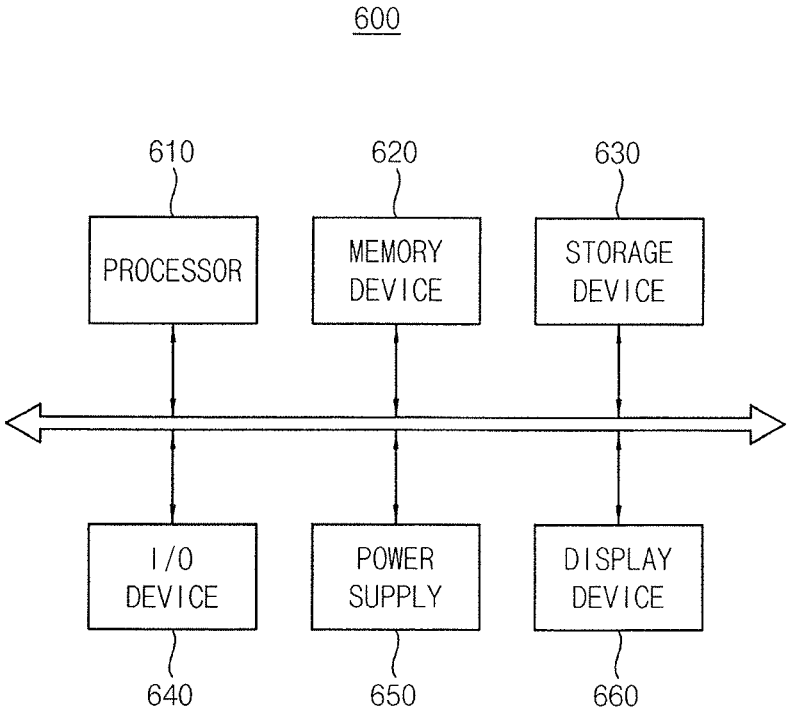
FIG. 20 illustrates an embodiment of an electronic device.

FIG. 20 illustrates an embodiment of an electronic device 600 which includes a processor 610, a memory device 620, a storage device 630, an input/output (I/O) device 640, a power supply 650, and a display device 660. The electronic device 600 may further include a plurality of ports for communicating with a video card, a sound card, a memory card, a universal serial bus (USB) device, other electronic devices, etc.

The processor 610 may perform various computing functions. The processor 610 may be a microprocessor, a central processing unit (CPU), etc. The processor 610 may be coupled to other components via an address bus, a control bus, a data bus, etc. Further, the processor 610 may be coupled to an extended bus such as a peripheral component interconnection (PCI) bus.

The memory device 620 may store data for operations of the electronic device 600. For example, the memory device 620 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 630 may be a solid state drive (SSD) device, a hard disk drive (HDD) device, a CD-ROM device, etc. The I/O device 640 may be an input device such as a keyboard, a keypad, a touchpad, a touch-screen, a mouse, etc, and an output device such as a printer, a speaker, etc. The power supply 650 may provide a power for operations of the electronic device 600. The display device 660 may communicate with other components via the buses or other communication links. The display device 660 may be, for example, the display device 500 of FIG. 19.

The electronic device 600 may be a smart phone, a digital or 3D television, a computer monitor, a home appliance, a laptop, a digital camera, a cellular phone, a personal digital assistant, a portable multimedia player, an MP3 player, a portable game console, a navigation system, a video phone, or another type of electronic device equipped with a display.

In accordance with another embodiment, a non-transitory computer-readable medium stores code for controlling operation of a display device. The code may control one or more of a computer, controller, processor, microprocessor, or other circuit to perform the operations of any of the aforementioned embodiments. The computer-readable medium may be a volatile or non-volatile memory or other storage device, which may be removably or fixedly coupled to the computer, processor, controller, or other circuit which is to execute the code or instructions for performing the method embodiments described herein.

For example, the code may include first code to generate R, G, and B reference voltage drops corresponding to R, G, and B data of a first pixel among a plurality of pixels, second code to calculate pixel voltage drops of the pixels based on R, G, and B data of the pixels, which are sequentially input as the R, G, and B data of the first pixel, and to output a first pixel voltage drop of the first pixel, third code to generate R, G, and B compensation data to compensate a luminance distortion of the first pixel and a color coordinate distortion of the first pixel based on a difference between the first pixel voltage drop and the R, G, and B reference voltage drops, the luminance distortion and the color coordinate distortion corresponding to the first pixel voltage drop; and fourth code to generate compensated R, G, and B data by adding the R, G, and B data of the first pixel and the R, G, and B compensation data, respectively.

The compensator and other control and processing features of the disclosed embodiments may be implemented in logic which, for example, may include hardware, software, or both. When implemented at least partially in hardware, the compensator and other control and processing features may be, for example, any one of a variety of integrated circuits including but not limited to an application-specific integrated circuit, a field-programmable gate array, a combination of logic gates, a system-on-chip, a microprocessor, or another type of processing or control circuit.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

When implemented in at least partially in software, the compensator and other control and processing features may include, for example, as indicated above, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A data compensator, comprising:

a reference voltage drop generator to generate R, G, and B reference voltage drops corresponding to R, G, and B data of a first pixel among a plurality of pixels in a display panel;

a voltage drop measurer to calculate pixel voltage drops of the pixels based on R, G, and B data of the pixels, which are sequentially input as the R, G, and B data of the first pixel, the pixel voltage drops corresponding to voltage drops along wires that carry the R, G, and B data to the pixels including the first pixel, the voltage drop measurer to output a first pixel voltage drop of the first pixel;

a compensation data generator to generate R, G, and B compensation data compensating a luminance distortion of the first pixel and a color coordinate distortion of the first pixel based on a difference between the first pixel voltage drop and the R, G, and B reference voltage drops, at least two of the R, G, and B compensation data being different based on differences in the first pixel voltage drop and the R, G, and B reference voltage drops, the luminance distortion and the color coordinate distortion corresponding to the first pixel voltage drop; and an output block to generate compensated R, G, and B data by adding the R, G, and B data of the first pixel and the R, G, and B compensation data, respectively.

2. The data compensator as claimed in claim 1, wherein the reference voltage drop generator is to generate the R, G, and B reference voltage drops corresponding to the R, G, and B data of the first pixel based on a pre-defined relationship between gray level and reference voltage drop.

3. The data compensator as claimed in claim 2, wherein:

the reference voltage drop generator is to store a formula representing the pre-defined relationship, the reference voltage drop generator is to generate the R, G, and B reference voltage drops by assigning gray levels of the R, G, and B data of the first pixel as the gray level of the pre-defined relationship.

4. The data compensator as claimed in claim 2, wherein:

the reference voltage drop generator is to store a look-up table representing the pre-defined relationship, the reference voltage drop generator is to generate the R, G, and B reference voltage drops corresponding to gray levels of the R, G, and B data of the first pixel based on the look-up table.

5. The data compensator as claimed in claim 1, wherein:

the compensation data generator is to generate the R, G, and B compensation data, and each of the R, G, and B compensation data is in proportion to a difference between the first pixel voltage drop and the R, G, and B reference voltage drops.

6. The data compensator as claimed in claim 1, wherein the compensation data generator is to generate the R, G, and B compensation data having positive values when the first pixel voltage drop is larger than each of the R, G, and B reference voltage drops.

7. The data compensator as claimed in claim 1, wherein the compensation data generator is to generate the R, G, and B compensation data having a value of 0 when the first pixel voltage drop is substantially equal to each of the R, G, and B reference voltage drops.

8. The data compensator as claimed in claim 1, wherein the compensation data generator is to generate the R, G, and B compensation data having negative values when the first pixel voltage drop is less than each of the R, G, and B reference voltage drops.

9. The data compensator as claimed in claim 1, wherein the voltage drop measurer is to calculate the first pixel voltage drop two-dimensionally.

10. The data compensator as claimed in claim 1, wherein:

the pixels are divided into first through (N)-th blocks, N is a natural number, and the voltage drop measurer includes:

a block voltage drop measurer to calculate a block voltage drop corresponding to a measuring block based on the R, G, and B data of the pixels;

a block voltage drop storage to store the block voltage drop; and a pixel voltage drop calculator to generate the first pixel voltage drop by interpolating a plurality of block voltage drops stored in the block voltage drop storage.

11. The data compensator as claimed in claim 10, wherein the block voltage drop measurer includes:

a coefficient table to output an X-axis voltage drop distribution coefficient and a Y-axis voltage drop distribution coefficient which correspond to a current sink block coordinate and a measuring block coordinate, the current sink block coordinate to point to a current sink block and the measuring block coordinate to point to the measuring block;

a block current calculator to output a current of the current sink block based on the R, G, and B data of the pixels and the current sink block coordinate;

a coordinate generator to generate the measuring block coordinate and to generate the current sink block coordinate moving through all coordinates of the first through (N)-th blocks; and a block voltage drop calculator to calculate a block voltage drop of the measuring block, which is generated by the currents of the first through (N)-th blocks, based on the X-axis voltage drop distribution coefficient, the Y-axis voltage drop distribution coefficient, and the current of the current sink block, the block voltage drop calculator configured to output the block voltage drop of the measuring block as the block voltage drop.

12. The data compensator as claimed in claim 11, wherein the block current calculator includes:

a current converter to convert the R, G, and B data of the pixels to a plurality of pixel currents;

a block current adder to store a sum of pixels currents corresponding to pixels included in (K)-th block among the first through (N)-th blocks as current of the (K)-th block (K is a natural number less than or equal to N); and a multiplexer to output current of a block corresponding to the current sink block coordinate among the currents of the first through (N)-th block as current of the current sink block.

13. The data compensator as claimed in claim 11, wherein:

a first X-axis voltage drop distribution coefficient is equal to a second X-axis voltage drop distribution coefficient when a first vector and a second vector are symmetric with respect to an X-axis, the first X-axis voltage drop distribution coefficient corresponds to a first current sink block coordinate and a first measuring block coordinate, the second X-axis voltage drop distribution coefficient corresponds to a second current sink block coordinate and a second measuring block coordinate, the first vector is from the first current sink block coordinate to the first measuring block coordinate, and the second vector is from the second current sink block coordinate to the second measuring block coordinate.

14. The data compensator as claimed in claim 13, wherein:

the coefficient table is to only store the first X-axis voltage drop distribution coefficient among the first and second X-axis voltage drop distribution coefficients, the coefficient table is to output the first X-axis voltage drop distribution coefficient in response to the second current sink block coordinate and the second measuring block coordinate.

15. The data compensator as claimed in claim 11, wherein:

a first X-axis voltage drop distribution coefficient is equal to a second X-axis voltage drop distribution coefficient when a first vector and a second vector are symmetric with respect to a Y-axis, the first X-axis voltage drop distribution coefficient corresponds to a first current sink block coordinate and a first measuring block coordinate, the second X-axis voltage drop distribution coefficient corresponds to a second current sink block coordinate and a second measuring block coordinate, the first vector is from the first current sink block coordinate to the first measuring block coordinate, and the second vector is from the second current sink block coordinate to the second measuring block coordinate.

16. The data compensator as claimed in claim 15, wherein:

the coefficient table is to only store the first X-axis voltage drop distribution coefficient among the first and second X-axis voltage drop distribution coefficients, the coefficient table is to output the first X-axis voltage drop distribution coefficient in response to the second current sink block coordinate and the second measuring block coordinate.

17. A display device, comprising:

a display panel including a plurality of pixels;

a data compensator to generate compensated R, G, and B data based on R, G, and B data of a first pixel among the pixels;

a timing controller to generate a data driver control signal and a scan driver control signal based on the compensated R, G, and B data;

a data driver to generate a plurality of data signals based on the data driver control signal, the data driver to provide the data signals to the pixels through a plurality of data signal lines; and a scan driver to generate a plurality of scan signals based on the scan driver control signal, the scan driver to provide the scan signals to the pixels through a plurality of scan signal lines, wherein the data compensator includes:

a reference voltage drop generator to generate R, G, and B reference voltage drops corresponding to R, G, and B data of the first pixel;

a voltage drop measurer to calculate pixel voltage drops of the pixels based on R, G, and B data of the pixels, which are sequentially input as R, G, and B data of the first pixel, the pixel voltage drops corresponding to voltage drops along wires that carry the R, G, and B data to the pixels including the first pixel, the voltage drop measurer to output a first pixel voltage drop of the first pixel;

a compensation data generator to generate R, G, and B compensation data to compensate a distortion of the first pixel based on the first pixel voltage drop and the R, G, and B reference voltage drops, at least two of the R, G, and B compensation data being different based on differences in the first pixel voltage drop and the R, G, and B reference voltage drops, the distortion generated by the first pixel voltage drop; and an output block to generate the compensated R, G, and B data by adding the R, G, and B data of the first pixel and the R, G, and B compensation data, respectively.

18. The display device as claimed in claim 17, wherein:

the compensation data generator is to generate the R, G, and B compensation data to reduce a luminance distortion of the first pixel and a color coordinate distortion of the first pixel simultaneously based on difference between the first pixel voltage drop and the R, G, and B reference voltage drops when the display device operates in a first mode to reduce the luminance distortion and the color coordinate distortion, and the compensation data generator is to generate the R, G, and B compensation data to reduce the luminance distortion based on the first pixel voltage drop when the display device operates in a second mode to reduce power consumption.

19. A non-transitory computer-readable medium for storing code for controlling operation of a display device, the display device including a processor to execute the code, the code comprising:

first code to be executed by the processor to generate R, G, and B reference voltage drops corresponding to R, G, and B data of a first pixel among a plurality of pixels;

second code to be executed by the processor to calculate pixel voltage drops of the pixels based on R, G and B data of the pixels, which are sequentially input as the R, G and B data of the first pixel, the pixel voltage drops corresponding to voltage drops along wires that carry the R, G, and B data to the pixels including the first pixel, and to output a first pixel voltage drop of the first pixel;

third code to be executed by the processor to generate R, G, and B compensation data to compensate a luminance distortion of the first pixel and a color coordinate distortion of the first pixel based on a difference between the first pixel voltage drop and the R, G, and B reference voltage drops, at least two of the R, G, and B compensation data being different based on differences in the first pixel voltage drop and the R, G, and B reference voltage drops, the luminance distortion and the color coordinate distortion corresponding to the first pixel voltage drop; and fourth code to be executed by the processor to generate compensated R, G, and B data by adding the R, G, and B data of the first pixel and the R, G, and B compensation data, respectively.

20. The computer-readable medium as claimed in claim 19, wherein the first code is to be executed by the processor to generate the R, G, and B reference voltage drops corresponding to the R, G, and B data of the first pixel based on a pre-defined relationship between gray level and reference voltage drop.

* * * * *